US011634896B2

(12) United States Patent
Yan

(10) Patent No.: US 11,634,896 B2
(45) Date of Patent: Apr. 25, 2023

(54) OVERHEAD SHOWER CONNECTOR STRUCTURE

(71) Applicant: Xiamen Galenpoo Kitchen & Bathroom Technology Co, Ltd., Fujian (CN)

(72) Inventor: Xiaoling Yan, Xiamen (CN)

(73) Assignee: XIAMEN GALENPOO KITCHEN & BATHROOM TECHNOLOGY CO, LTD., Fujian (CN)

( * ) Notice: Subject to any disclaimer, the term of this patent is extended or adjusted under 35 U.S.C. 154(b) by 352 days.

(21) Appl. No.: 17/010,837

(22) Filed: Sep. 3, 2020

(65) Prior Publication Data

US 2022/0064921 A1 Mar. 3, 2022

(51) Int. Cl.

| | |
|---|---|
| ***E03C 1/06*** | (2006.01) |
| ***B05B 15/62*** | (2018.01) |
| ***B05B 15/65*** | (2018.01) |

(52) U.S. Cl.

CPC ..... *E03C 1/06* (2013.01); *B05B 15/62* (2018.02); *B05B 15/65* (2018.02)

(58) Field of Classification Search

CPC ..... E03C 1/06; B05B 15/62; B05B 15/65
See application file for complete search history.

(56) References Cited

U.S. PATENT DOCUMENTS

| | | | | |
|---|---|---|---|---|
| 6,024,331 | A * | 2/2000 | Bischoff | E03C 1/066 248/314 |
| 7,966,677 | B2 * | 6/2011 | Miller | E03C 1/06 4/570 |
| 8,028,935 | B2 * | 10/2011 | Leber | B29C 66/54 239/443 |
| 8,292,201 | B2 * | 10/2012 | Patterson | B05B 15/654 4/615 |
| 9,149,826 | B2 * | 10/2015 | Vartanian | B05B 15/65 |
| 9,347,208 | B2 * | 5/2016 | Quinn | E03C 1/0412 |
| 10,704,240 | B2 * | 7/2020 | Lin | E03C 1/066 |
| 2020/0061641 | A1 * | 2/2020 | Soetaert | B05B 1/18 |

* cited by examiner

*Primary Examiner* — Anita M King
(74) *Attorney, Agent, or Firm* — Leong C. Lei

(57) ABSTRACT

An overhead shower connector structure includes an overhead shower connector, a connecting rod assembly, and a bracket. The bracket is connected with the overhead shower connector through the connecting rod assembly. The overhead shower connector is configured to connect with the overhead shower. The bracket is configured to hold a hand shower. After installing the overhead shower connector, the bracket can be installed together, and there is no need to install the bracket separately. There is no need to fix the bracket to the wall, so that the overhead shower connector structure can facilitate the installation of the bracket and improve the installation efficiency. The overall structure of is simple.

13 Claims, 8 Drawing Sheets

OVERHEAD SHOWER CONNECTOR STRUCTURE

BACKGROUND OF THE INVENTION

1. Field of the Invention

The present invention relates to a shower, and more particularly to an overhead shower connector structure.

2. Description of the Prior Art

Overhead showers and hand showers are common shower products in our daily life. In general, an overhead shower and a hand shower are installed in a bathroom. In order to facilitate the placement of the hand shower when not in use, it is necessary to fix a bracket on the wall for the hand shower to be held on the bracket. It is not convenient to install the bracket.

Accordingly, the inventor of the present invention has devoted himself based on his many years of practical experiences to solve these problems.

SUMMARY OF THE INVENTION

The primary object of the present invention is to provide an overhead shower connector structure that is simple in structure and convenient for installation of a bracket.

In order to achieve the above object, the present invention adopts the following solutions.

An overhead shower connector structure comprises an overhead shower connector, a connecting rod assembly, and a bracket. The bracket is connected with the overhead shower connector through the connecting rod assembly.

Preferably, a hollow ball joint is formed on the overhead shower connector.

Preferably, the bracket is rotatable relative to the overhead shower connector.

Preferably, the connecting rod assembly includes a first rod, a second rod, a non-rotatable positioning member, a rotatable positioning member, a bolt, and a spring. The first rod is integrally formed with the overhead shower connector. The second rod is integrally formed with the bracket. The rotatable positioning member is rotatably connected to the non-rotatable positioning member. The non-rotatable positioning member is arranged in the first rod. The rotatable positioning member is arranged on the second rod. The bolt is inserted through the second rod and screwed to the first rod. The spring is sleeved onto the bolt. The bolt presses the spring into the second rod.

Preferably, the rotatable positioning member is formed with a plurality of spaced teeth and recesses each formed between every adjacent two of the teeth. The non-rotatable positioning member is formed with a plurality of spaced teeth and recesses each formed between every adjacent two of the teeth. The teeth of the non-rotatable positioning member are meshed with the recesses of the rotatable positioning member. The teeth of the rotatable positioning member are meshed with the recesses of the non-rotatable positioning member.

Preferably, the non-rotatable positioning member is integrally formed inside the first rod. The rotatable positioning member is integrally formed with the second rod. The rotatable positioning member is accommodated inside the first rod.

Preferably, an inner wall of the first rod is recessed with a plurality of spaced engaging grooves. One side of the non-rotatable positioning member, facing the first rod, is provided with a plurality of spaced engaging blocks. The engaging blocks of the non-rotatable positioning member are engaged in the corresponding engaging grooves of the first rod, respectively. An inner wall of the second rod is recessed with a plurality of spaced engaging grooves. One side of the rotatable positioning member, facing the second rod, is provided with a plurality of spaced engaging blocks. The engaging blocks of the rotatable positioning member are engaged in the corresponding engaging grooves of the second rod, respectively.

Preferably, a washer is provided between the spring and a top of the bolt.

Preferably, an outer side wall of the bracket is formed with an opening.

Preferably, one end of the opening has a width greater than that of another end of the opening.

After adopting the above technical solutions, the bracket of the present invention is connected to the overhead shower connector through the connecting rod assembly. The overhead shower connector is configured to connect with the overhead shower. The bracket is configured to hold a hand shower. Therefore, after installing the overhead shower connector, the bracket can be installed together, and there is no need to install the bracket separately. There is no need to fix the bracket to the wall, so that the present invention can facilitate the installation of the bracket and improve the installation efficiency. The overall structure of the present invention is simple.

DETAILED DESCRIPTION OF THE PREFERRED EMBODIMENTS

Figure 1:
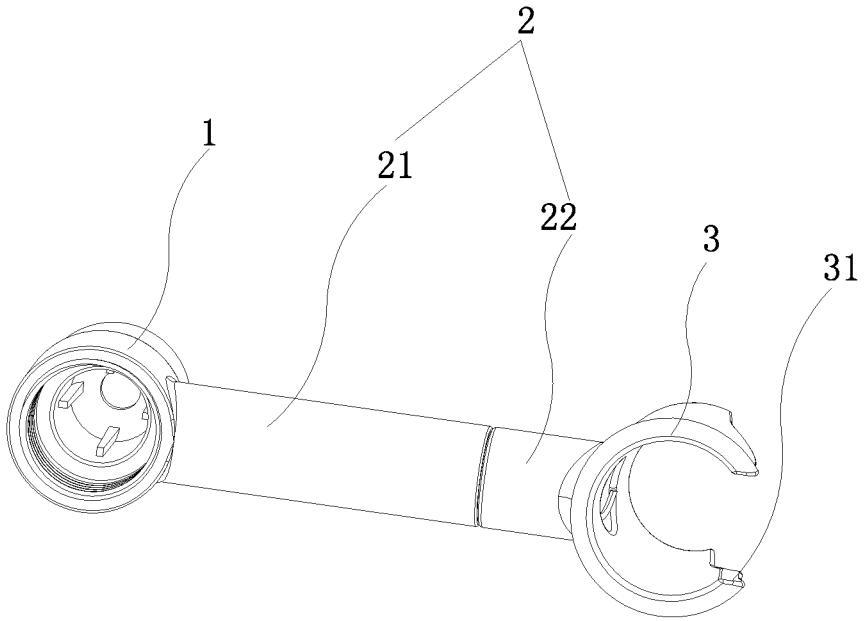
FIG. 1 is a first perspective view of the present invention.
Figure 2:
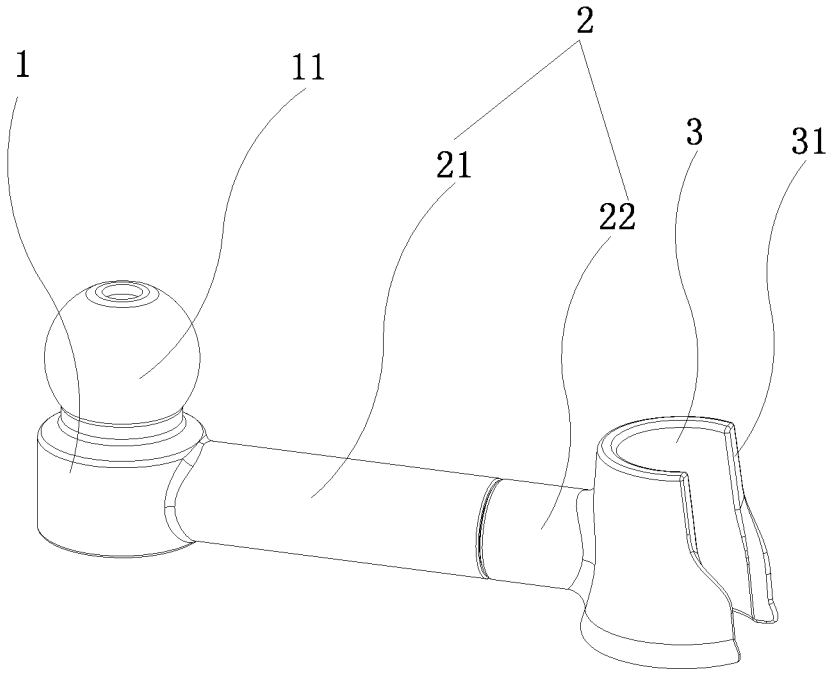
FIG. 2 is a second perspective view of the present invention.

In order to achieve the above-mentioned objectives and effects, the technical means and structure adopted by the present invention are described in detail below to illustrate the features and functions of the preferred embodiments of the present invention for a complete understanding of the present invention.

As shown in FIG. 1 through FIG. 8, the present invention discloses an overhead shower connector structure, comprising an overhead shower connector 1, a connecting rod assembly 2, and a bracket 3. The bracket 3 is connected with the overhead shower connector 1 through the connecting rod assembly 2.

Therefore, the bracket 3 of the present invention is connected with the overhead shower connector 1 through the connecting rod assembly 2. The overhead shower connector 1 is configured to connect with the overhead shower. The bracket 3 is configured to hold a hand shower. Therefore, after installing the overhead shower connector 1, the bracket 3 can be installed together, and there is no need to install the bracket 3 separately. There is no need to fix the bracket 3 to the wall, so that the present invention can facilitate the installation of the bracket 3 and improve the installation efficiency. The overall structure of the present invention is simple.

Furthermore, a hollow ball joint 11 is formed on the overhead shower connector 1. The ball joint 11 is configured to connect with an overhead shower, and the overhead shower can be rotated conveniently.

Further, the bracket 3 is rotatable relative to the overhead shower connector 1. The bracket 3 can be rotated to adjust the inclination angle as required, so that the hand shower can be inserted in the bracket 3 easily.

Further, the connecting rod assembly 2 includes a first rod 21, a second rod 22, a non-rotatable positioning member 23, a rotatable positioning member 24, a bolt 25, and a spring 26. The first rod 21 is integrally formed with the overhead shower connector 1. The second rod 22 is integrally formed with the bracket 3. The rotatable positioning member 24 is rotatably connected to the non-rotatable positioning member 23. The non-rotatable positioning member 23 is arranged in the first rod 21. The rotatable positioning member 24 is arranged on the second rod 22. The bolt 25 is inserted through the second rod 22 and screwed to the first rod 21. The spring 26 is sleeved onto the bolt 25. The bolt 25 presses the spring 26 into the second rod 22. The user can rotate the rotatable positioning member 24 by rotating the bracket 3 and the second rod 22 to adjust the connection position with the non-rotatable positioning member 23. After adjusting the bracket 3 to the required inclination angle, the bracket 3 is released and the rotatable positioning member 24 is pressed against the non-rotatable positioning member 23 through the elastic force of the spring 26, so that when the hand shower is inserted in the bracket 3, the rotatable positioning member 24 will not rotate.

The rotatable positioning member 24 is formed with a plurality of spaced teeth 234 and recesses 243 each formed between every adjacent two of the teeth 234. The non-rotatable positioning member 23 is formed with a plurality of spaced teeth 234 and recesses 243 each formed between every adjacent two of the teeth 234. The teeth 234 of the non-rotatable positioning member 23 are meshed with the recesses 243 of the rotatable positioning member 24, and the teeth 234 of the rotatable positioning member 24 are meshed with the recesses 243 of the non-rotatable positioning member 23, so that the rotatable positioning member 24 is rotatably connected to the non-rotatable positioning member 23, but not limited to this.

A washer 28 is provided between the spring 26 and the top of the bolt 25.

In order to facilitate the insertion of the hand shower, the outer side wall of the bracket 3 is formed with an opening 31.

The width of one end of the opening 31 is greater than the width of the other end of the opening 31, so that the other end of the opening 31 with a small width is configured to confine and hold the hand shower.

The differences between the first embodiment and the second embodiment of the present invention are described below.

Figure 3:
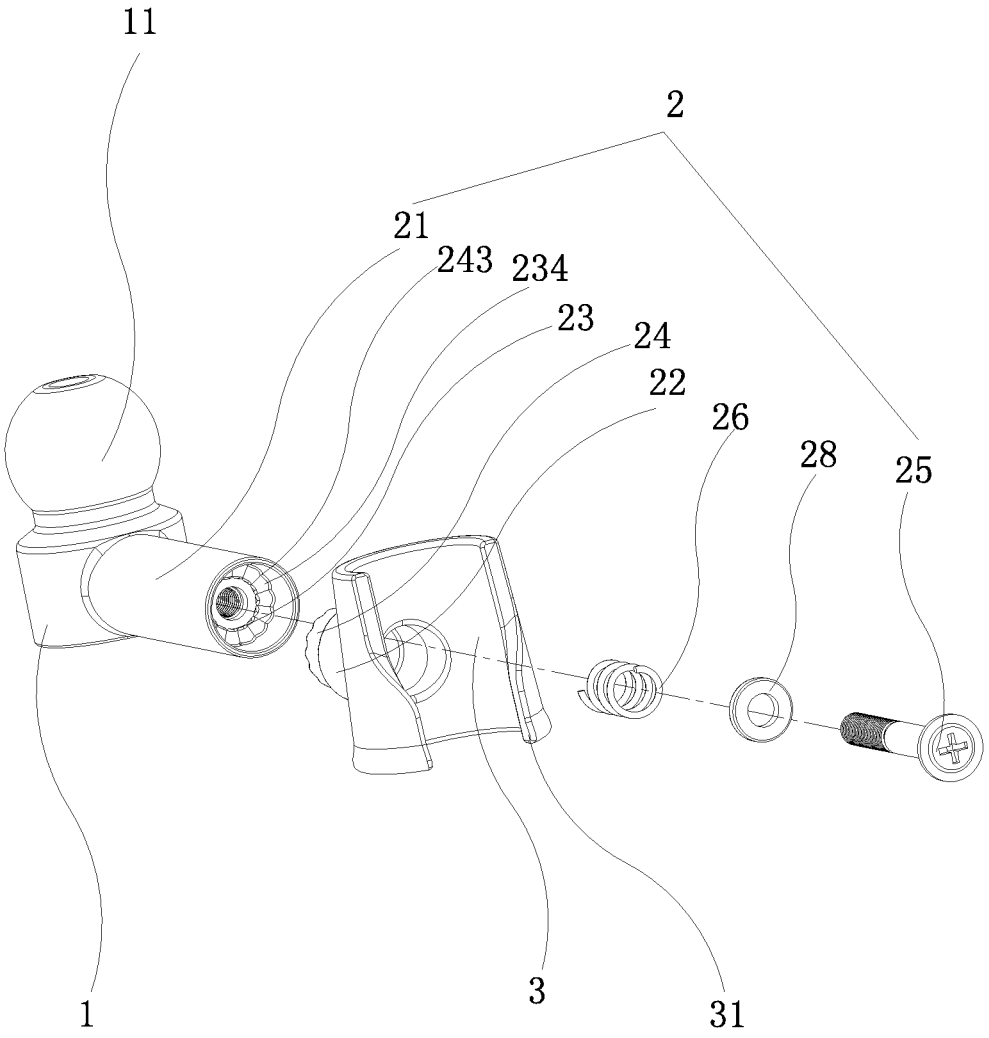
FIG. 3 is a first exploded view according to a first embodiment of the present invention.
Figure 4:
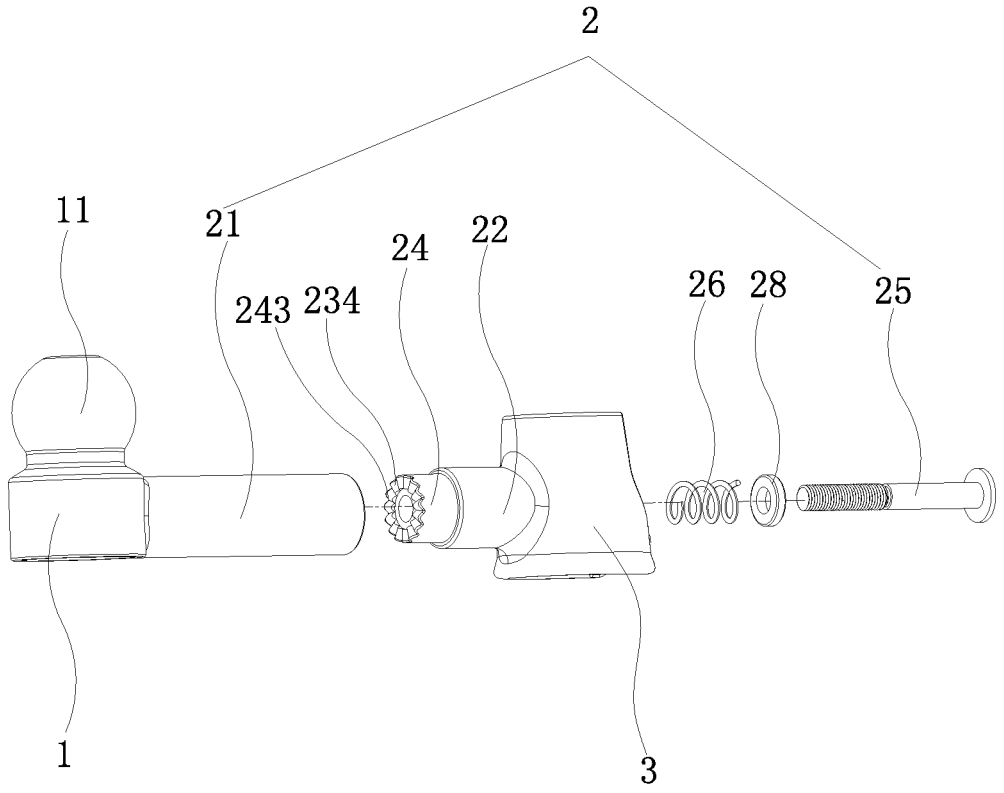
FIG. 4 is a second exploded view according to the first embodiment of the present invention.
Figure 5:
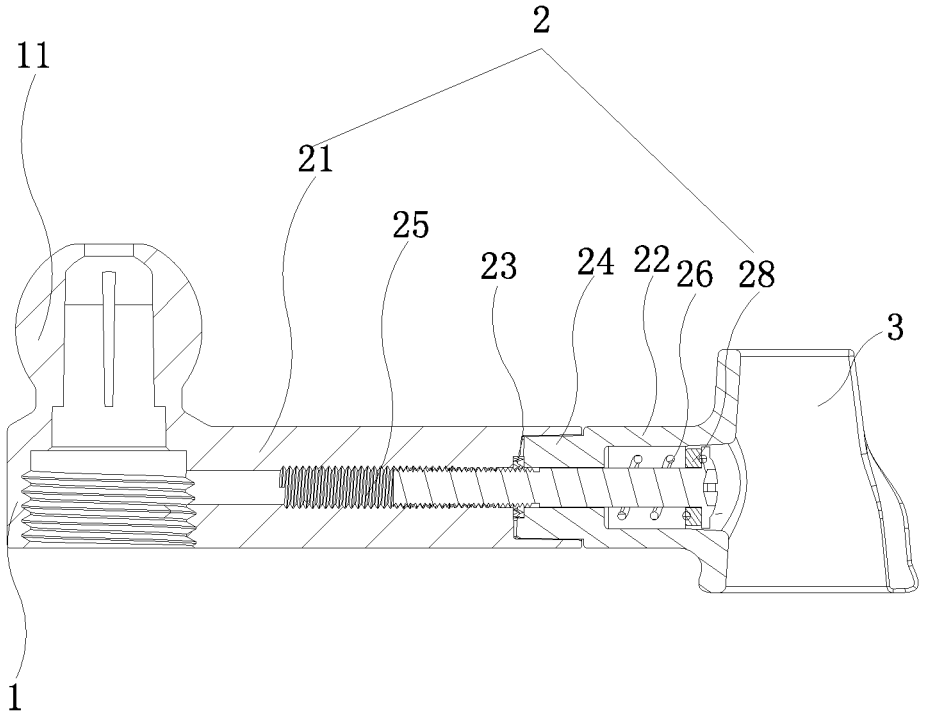
FIG. 5 is a cross-sectional view according to the first embodiment of the present invention.

Referring to FIGS. 3 to 5, in the first embodiment, in order to facilitate the manufacturing of the present invention, the non-rotatable positioning member 23 may be integrally formed inside the first rod 21, and the rotatable positioning member 24 may be integrally formed with the second rod 22, and the rotatable positioning member 24 may be accommodated inside the first rod 21.

Figure 6:
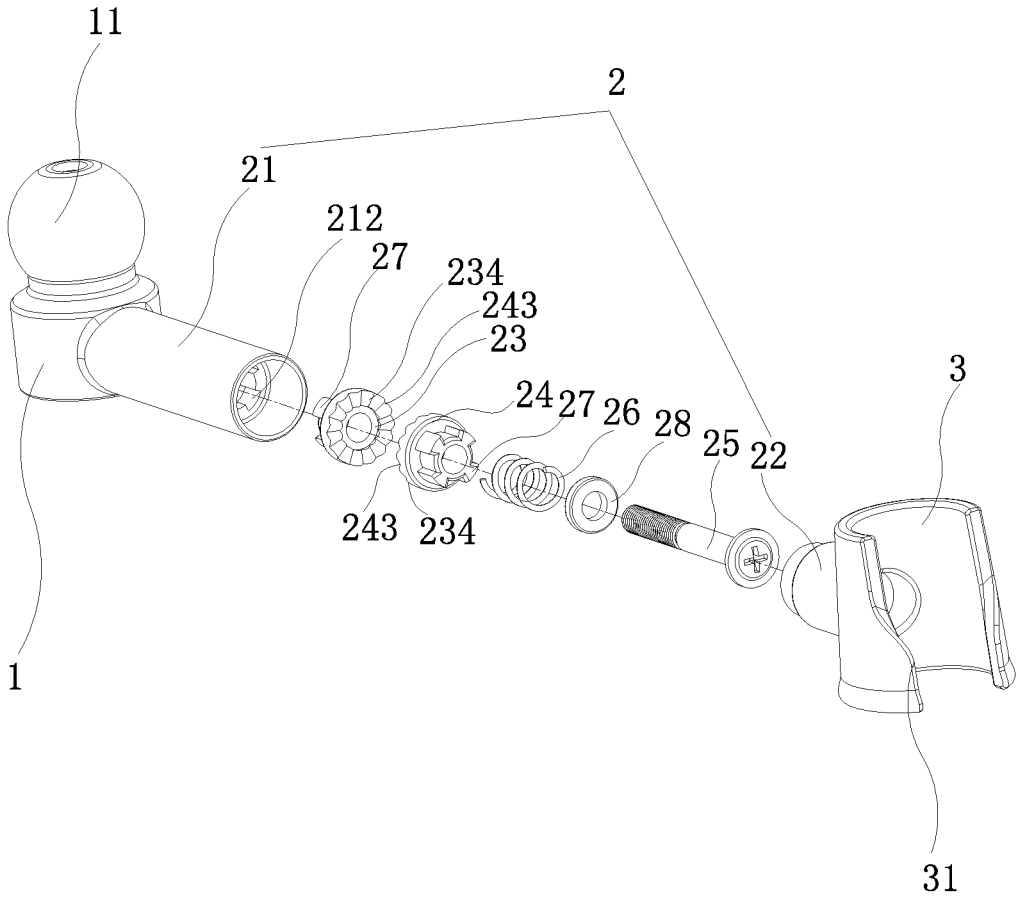
FIG. 6 is a first exploded view according to a second embodiment of the present invention.
Figure 7:
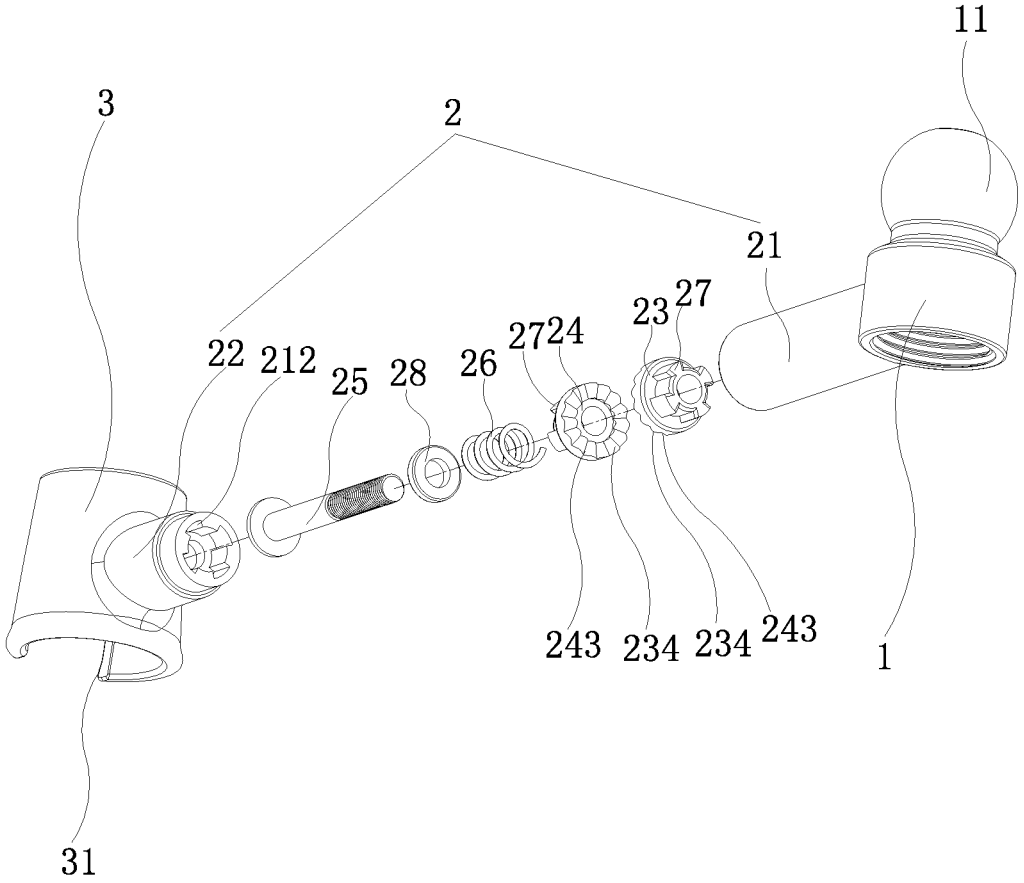
FIG. 7 is a second exploded view according to the second embodiment of the present invention.
Figure 8:
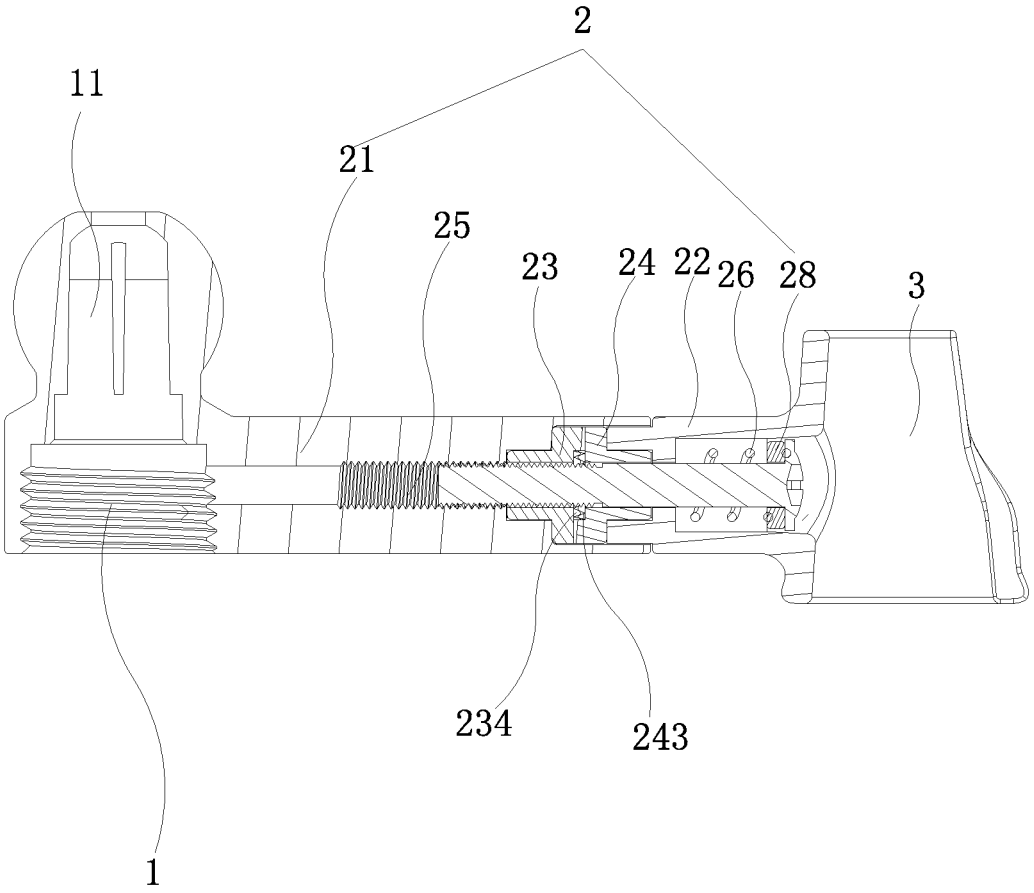
FIG. 8 is a cross-sectional view according to the second embodiment of the present invention.

Referring to FIGS. 6 to 8, in the second embodiment, the inner wall of the first rod 21 is recessed with a plurality of spaced engaging grooves 212. One side of the non-rotatable positioning member 23, facing the first rod 21, is provided with a plurality of spaced engaging blocks 27. The engaging blocks 27 of the non-rotatable positioning member 23 are engaged in the corresponding engaging grooves 212 of the first rod 21, respectively. The inner wall of the second rod 22 is recessed with a plurality of spaced engaging grooves 212. One side of the rotatable positioning member 24, facing the second rod 22, is provided with a plurality of spaced engaging blocks 27. The engaging blocks 27 of the rotatable positioning member 24 are engaged in the corresponding engaging grooves 212 of the second rod 22, respectively. The first rod 21 and the overhead shower connector 1 as well as the second rod 22 and the bracket 3 can be made of different materials.

Manufacturers can choose the materials according to their needs, as long as the non-rotatable positioning member 23 and the rotatable positioning member 24 are made of the same material. This can avoid the problem that in the first embodiment, if the first rod 21 and the overhead shower connector 1 as well as the second rod 22 and the bracket 3 are made of different materials and the non-rotatable positioning member 23 and the rotatable positioning member 24 are made of different materials, the components will suffer a lot of wear and tear.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. An overhead shower connector structure, comprising an overhead shower connector, a connecting rod assembly, and a bracket; the bracket being connected with the overhead shower connector through the connecting rod assembly; wherein a hollow ball joint is formed on the overhead shower connector; wherein the bracket is rotatable relative to the overhead shower connector; and, wherein the connecting rod assembly includes a first rod, a second rod, a non-rotatable positioning member, a rotatable positioning member, a bolt and a spring, the first rod is integrally formed with the overhead shower connector, the second rod is integrally formed with the bracket, the rotatable positioning member is rotatably connected to the non-rotatable positioning member, the non-rotatable positioning member is arranged in the first rod, the rotatable positioning member is arranged on the second rod, the bolt is inserted through the second rod and screwed to the first rod, the spring is sleeved onto the bolt, and the bolt presses the spring into the second rod.

2. The overhead shower connector structure as claimed in claim 1, wherein the rotatable positioning member is formed with a plurality of spaced teeth and recesses each formed between every adjacent two of the teeth, the non-rotatable positioning member is formed with a plurality of spaced teeth and recesses each formed between every adjacent two of the teeth, the teeth of the non-rotatable positioning member are meshed with the recesses of the rotatable positioning member, and the teeth of the rotatable positioning member are meshed with the recesses of the non-rotatable positioning member.

3. The overhead shower connector structure as claimed in claim 1, wherein the non-rotatable positioning member is integrally formed inside the first rod, the rotatable positioning member is integrally formed with the second rod, and the rotatable positioning member is accommodated inside the first rod.

4. The overhead shower connector structure as claimed in claim 1, wherein an inner wall of the first rod is recessed with a plurality of spaced engaging grooves, one side of the non-rotatable positioning member, facing the first rod, is provided with a plurality of spaced engaging blocks, the engaging blocks of the non-rotatable positioning member are engaged in the corresponding engaging grooves of the first rod, respectively; an inner wall of the second rod is recessed with a plurality of spaced engaging grooves, one side of the rotatable positioning member, facing the second rod, is provided with a plurality of spaced engaging blocks, and the engaging blocks of the rotatable positioning member are engaged in the corresponding engaging grooves of the second rod, respectively.

5. The overhead shower connector structure as claimed in claim 1, wherein a washer is provided between the spring and a top of the bolt.

6. The overhead shower connector structure as claimed in claim 1, wherein an outer side wall of the bracket is formed with an opening.

7. The overhead shower connector structure as claimed in claim 6, wherein one end of the opening has a width greater than that of another end of the opening.

8. The overhead shower connector structure as claimed in claim 1, wherein the bracket is rotatable relative to the overhead shower connector.

9. The overhead shower connector structure as claimed in claim 8, wherein the connecting rod assembly includes a first rod, a second rod, a non-rotatable positioning member, a rotatable positioning member, a bolt and a spring, the first rod is integrally formed with the overhead shower connector, the second rod is integrally formed with the bracket, the rotatable positioning member is rotatably connected to the non-rotatable positioning member, the non-rotatable positioning member is arranged in the first rod, the rotatable positioning member is arranged on the second rod, the bolt is inserted through the second rod and screwed to the first rod, the spring is sleeved onto the bolt, and the bolt presses the spring into the second rod.

10. The overhead shower connector structure as claimed in claim 9, wherein the rotatable positioning member is formed with a plurality of spaced teeth and recesses each formed between every adjacent two of the teeth, the non-rotatable positioning member is formed with a plurality of spaced teeth and recesses each formed between every adjacent two of the teeth, the teeth of the non-rotatable positioning member are meshed with the recesses of the rotatable positioning member, and the teeth of the rotatable positioning member are meshed with the recesses of the non-rotatable positioning member.

11. The overhead shower connector structure as claimed in claim 9, wherein the non-rotatable positioning member is integrally formed inside the first rod, the rotatable positioning member is integrally formed with the second rod, and the rotatable positioning member is accommodated inside the first rod.

12. The overhead shower connector structure as claimed in claim 9, wherein an inner wall of the first rod is recessed with a plurality of spaced engaging grooves, one side of the non-rotatable positioning member, facing the first rod, is provided with a plurality of spaced engaging blocks, the engaging blocks of the non-rotatable positioning member are engaged in the corresponding engaging grooves of the first rod, respectively; an inner wall of the second rod is recessed with a plurality of spaced engaging grooves, one side of the rotatable positioning member, facing the second rod, is provided with a plurality of spaced engaging blocks, and the engaging blocks of the rotatable positioning member are engaged in the corresponding engaging grooves of the second rod, respectively.

13. The overhead shower connector structure as claimed in claim 9, wherein a washer is provided between the spring and a top of the bolt.

* * * * *